United States Patent [19]

Avella

[11] Patent Number: 4,586,440

[45] Date of Patent: May 6, 1986

[54] CONTROLLED MOUNTING FOR LUMINAIRE ON TILTABLE DRAFTING BOARD

[75] Inventor: Frank S. Avella, Irvine, Calif.

[73] Assignee: Plan Hold Corporation, Irvine, Calif.

[21] Appl. No.: 692,014

[22] Filed: Jan. 15, 1985

[51] Int. Cl.[4] ..... A47B 85/00

[52] U.S. Cl. ..... 108/23; 108/7

[58] Field of Search ..... 108/7, 1, 23, 147; 248/291, 292.1, 201; 362/33, 427, 428, 401, 402; 312/231

[56] References Cited

U.S. PATENT DOCUMENTS

| | | | |
|---|---|---|---|
| 2,131,708 | 9/1938 | Lesperance | 108/23 |
| 2,864,432 | 12/1958 | Limberg | 297/379 |
| 2,943,897 | 7/1960 | Johnson et al. | 108/23 X |
| 3,163,939 | 1/1965 | Heyer | 108/23 X |
| 4,165,530 | 8/1979 | Sowden | 362/427 X |
| 4,372,631 | 2/1983 | Leon | 312/231 |
| 4,397,245 | 8/1983 | Washburn | 108/7 |

FOREIGN PATENT DOCUMENTS

| | | | |
|---|---|---|---|
| 2046487 | 5/1971 | Fed. Rep. of Germany | 108/7 |

*Primary Examiner*—William E. Lyddane
*Assistant Examiner*—José V. Chen
*Attorney, Agent, or Firm*—Poms, Smith, Lande & Rose

[57] ABSTRACT

An apparatus for counterbalancing a luminaire pivotally mounted on a drafting board which is adapted to be inclined to a selected working position from approximately 0 degrees to 90 degrees in which the luminaire is provided with support members pivotally mounted on the board and first and second friction control devices are cooperable with the pivotal mounting to provide necessary counterbalancing forces in selected positions of the luminaire. The second control device is activated by a gravity responsive latch when the board is inclined beyond a selected angle of inclination to augment the counterbalancing forces where the gravity moment arm of the luminaire enters a maximum range.

15 Claims, 13 Drawing Figures

104°
GM
20
21
23
24
25
26
27
30
80

Fig. 10.
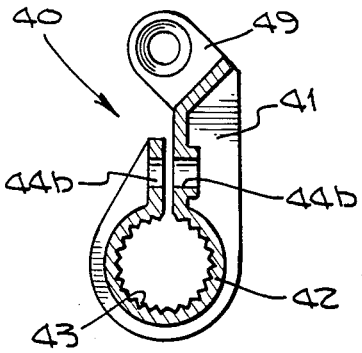
Fig. 11.
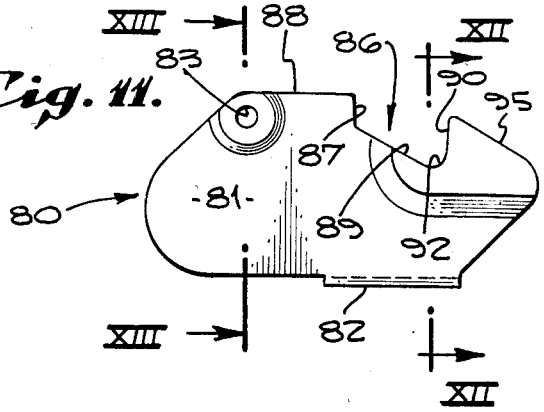
Fig. 12.
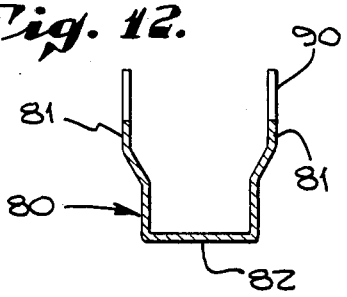
Fig. 6.
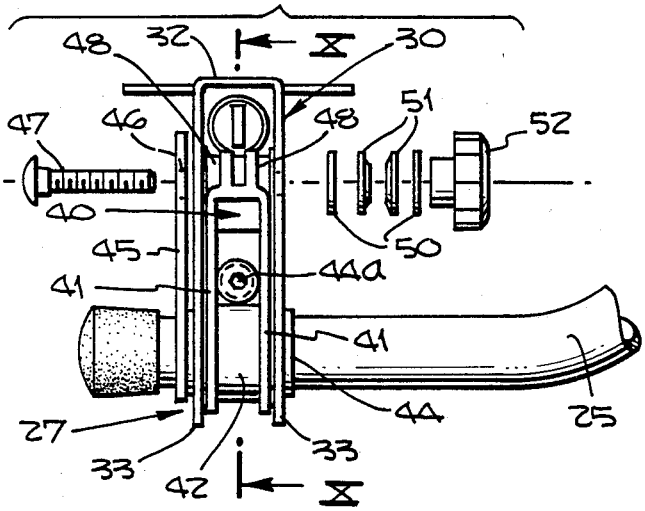
Fig. 13.
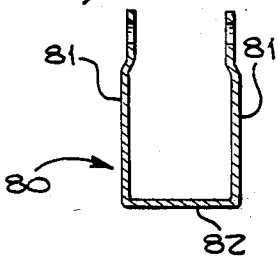
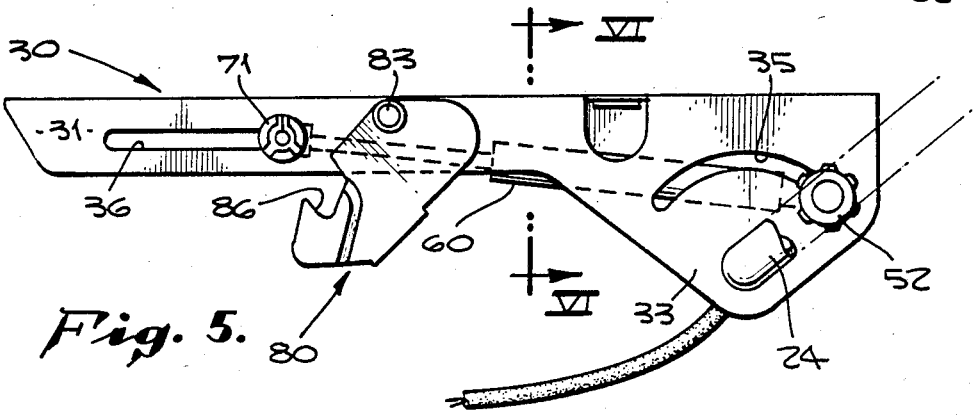
Fig. 5.

IX
IX

CONTROLLED MOUNTING FOR LUMINAIRE ON TILTABLE DRAFTING BOARD

BACKGROUND OF THE INVENTION

The present invention relates to a controlled mounting for readily positioning and maintaining a selected desired position of a luminaire of strip type over a working or drafting surface of a drafting board hingedly mounted on a drafting table for movement between horizontal and approximately vertical positions for example from 0 to approximately 90 degrees. The strip luminaire may extend across the work surface in parallel relation to the top and bottom edges of the drafting board and may be pivotally mounted at side edges of the board for movement through a selected angle relative to the work surface on the drafting board to illuminate work areas as desired.

Many drafting boards are hingedly mounted at their bottom edge to permit positioning of the drafting board at a desired work plane. Some draftsmen prefer to draw with the drafting board horizontal or only slightly inclined. Other draftsmen prefer to draw with the drafting board inclined at a substantially greater angle such as between 45 degrees to 90 degrees. The practice of many European architect and engineering draftsmen is to position the board between 45 to almost 90 degrees. When a drafting board is in a position near horizontal and illuminated by a luminaire strip-type lighting device supported in vertical spaced relation above the drawing surface by vertically disposed support members hinged along side edges of the drafting board, it will be understood that the force moment of the weight of the strip-type luminaire device is not large, and position maintenance and stability requires minimal counterbalancing forces. Strip-type luminaire devices are usually adapted to be pivoted through an included angle of approximately 104 degrees to selectively bring effective light to a desired portion of the work surface. However when the drafting board is tilted, for example, to an angle of between 45 degrees to almost 90 degrees, the gravitational force moment acting on a strip-type luminaire device becomes substantially greater and greater counterbalancing forces are required in the mounting of the support members for the strip-type luminaire device.

Prior proposed counterbalancing means for such lighting devices for a drafting board have included friction means which may be adjustably tightened to retain the support member of a strip-type luminaire device in selected position with respect to the drafting surface for desired illumination. Such counterbalancing friction means have included adjustable friction nuts acting at the pivotal axis of the support member of the luminaire device. Piston and cylinder-type gas spring means connected between the support member of the luminaire and the drafting board have also been used. In such prior proposed counterbalancing means, the gas spring means was included on a drafting table which was specifically designed for use in a position between about 45° to 90°. When such specifically designed drafting table was used in a horizontal position, the gas spring means was not operable and modifications were required to be made in the support of the luminaire to facilitate its positioning during lower, near horizontal inclined positions of the drafting board.

Such prior proposed mounting means for strip-type luminaire devices included disadvantages in that positioning of the strip-type luminaire device to any position during inclination of the drafting board between 0 and 90 degrees was not accomplished without modification of the mounting means; and where gas spring means were used, the gas spring means were operable for only a portion of the inclined positions of the drafting board.

SUMMARY OF THE INVENTION

The present invention provides a controlled mounting for a strip-type luminaire over a drafting board which is readily positioned and maintained through various degrees of inclination of the drafting board from 0 to 90 degrees or generally from horizontal to vertical positions and also for various intermediate angular positions of the strip-type luminaire relative to the drafting board surface. The invention contemplates the utilization of counterbalancing means which include control means for ready adjustment and smooth operation of the strip-type luminaire by a first set of counterbalancing means, and automatic actuation of a second counterbalancing means at a selected angle of inclination of the board by means of a gravity responsive pendulum type latch which engages one end of a gas spring means for causing actuation of said gas spring means as a counterbalancing means, the gas spring means being inoperable during one stage of the inclination of the drafting board in which the first set of counterbalancing means is operable.

The invention therefore contemplates a novel construction and method of operation of counterbalancing means for controlling the position of a strip-type luminaire over a work surface.

The primary object of the present invention is to provide a novel construction and method of counterbalancing a strip-type luminaire over a drafting board which is inclined from horizontal to substantially vertical positions and in which the luminaire is moved relative to the drafting board surface through selected angles for desired illumination of areas of the drafting board.

An object of the present invention is to provide a controlling means for selectively positioning and maintaining a strip-type luminaire over a work surface.

Another object of the present invention is to provide a control means for a luminaire support member which includes a first control means and a second control means cooperable with crank means connected with said support member and moveable along a path provided by a bracket for counterbalancing and maintaining a selected position of the luminaire support member.

Another object of the invention is to provide an apparatus as described above wherein said second means includes a gas spring means and a latch means cooperable therewith for activating the gas spring means.

A further object of the invention is to provide a control means for positioning and retaining in such position a strip-type luminaire wherein said control means includes a gravity responsive latch member which maintains a gravity selected position while the drafting board moves through variable angles of inclination.

A still further object of the present invention is to provide a control mounting for the support members of a strip-type luminaire for a work surface wherein said control means includes a bracket member having longitudinally-spaced slots for guiding opposite ends of a gas spring means, friction means associated with said opposite ends for controlling the relative position of the strip-type luminaire with respect to the work surface at certain angles of inclination of the work surface, and a latch member cooperable with one end of said gas spring means for automatically activating said gas spring means for controlling the position of the strip-type luminaire over different variable angles of inclination of the work surface.

Various other objects and advantages of the present invention will be readily apparent from the following description of the drawings in which an exemplary embodiment of this invention is shown.

IN THE DRAWINGS

FIG. 5 is an enlarged side elevation of a bracket luminaire support member, and pendulum latch member in the position shown in FIG. 1;

FIG. 6 is a fragmentary partially exploded view of the pivotal mounting between the luminaire support member and bracket member shown in FIG. 5 and taken from the plane indicated at VI—VI of FIG. 5;

FIG. 10 is a sectional view taken through the plane indicated by line X—X of FIG. 6;

FIG. 11 is a side view of the gravity latch;

FIG. 12 is a sectional view in the plane indicated by line XII—XII of FIG. 11; and FIG. 13 is a section in the plane indicated by line XIII—XIII of FIG. 11.

DETAILED DESCRIPTION

Figures 1, 2, 3, 4:
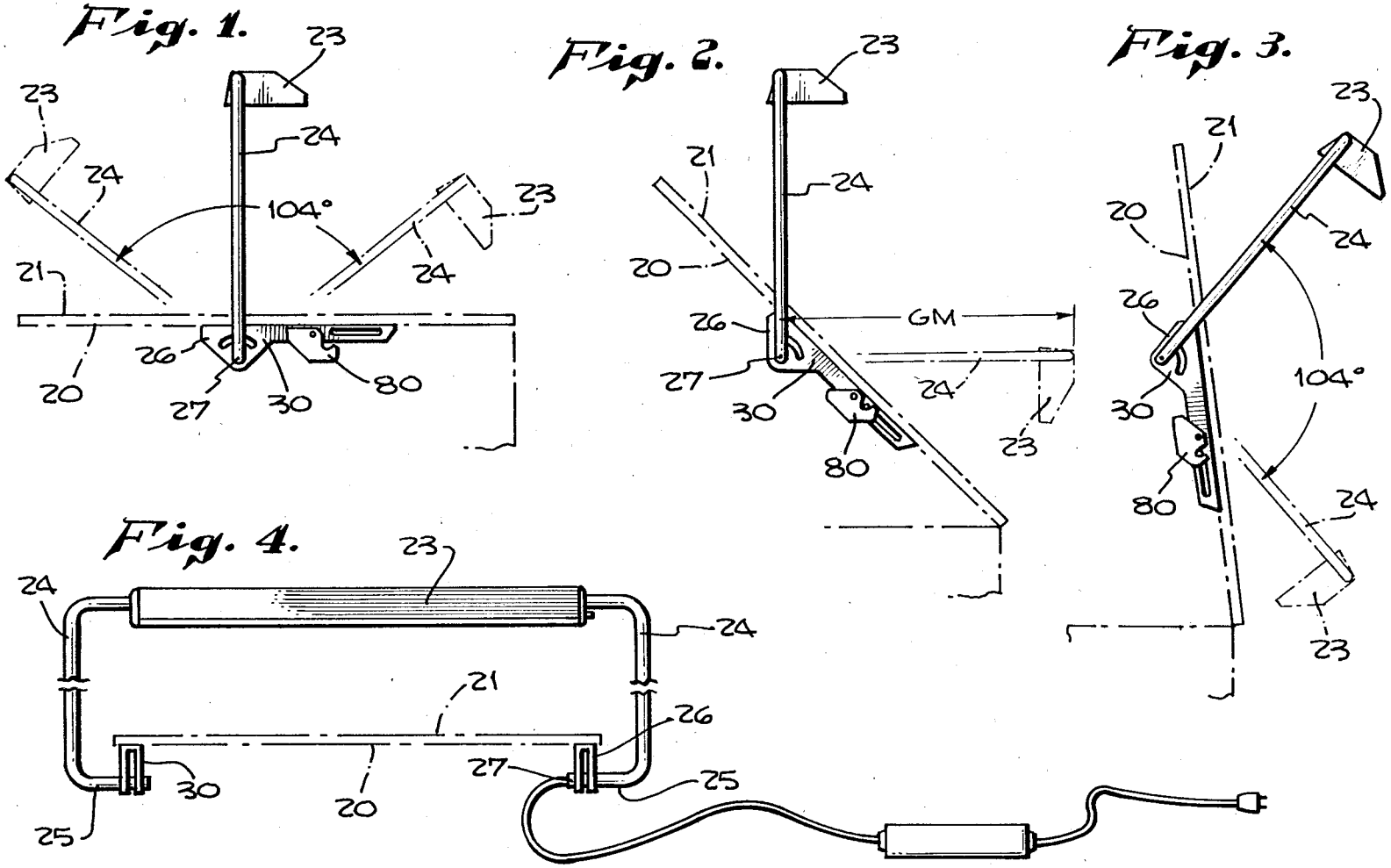
FIG. 1 is a schematic fragmentary elevational view of a horizontally disposed drawing board provided with a strip-type luminaire held over the drawing board by a support member in 90 degree relation to the work surface on the drawing board.
FIG. 2 is a schematic fragmentary side elevation of FIG. 1 with the drawing board inclined at approximately 45 degrees to horizontal.
FIG. 3 is a schematic fragmentary view of the drawing board in FIGS. 1 and 2 with the drawing board inclined at approximately 90 degrees to horizontal.
FIG. 4 is a schematic fragmentary front view showing the drawing board, luminaire and luminaire support member of FIG. 1.

With reference first to FIGS. 1–4, inclusive, a drafting table (not shown) includes a drawing board 20 having a drawing or work surface 21 to which may be attached drawing sheets on which a draftsman may illustrate the work. Above work surface 21 may be an elongated strip-type luminaire 23 which extends above and across work surface 21 from one side edge of the board 20 to the other side edge of the board (FIG. 4). Luminaire 23 includes support members 24 of suitable material, such as tubular stock. Each support member 24 extends from the luminaire outwardly and downwardly in spaced relation to the side edges of board 20 and therebelow to provide an inwardly turned end portion 25 adapted to be pivotally mounted in a bracket means 26 secured to board 20. The pivotal mounting at 27 permits support members 24 to be adjusted in angular relation to work surface 21 to provide desired illumination of the work surface. Relative to the work surface 21, support members 24 may swing through selected included angles such as a range of 104 degrees. Such an angular range with a support member of approximately 15 inches in length will provide an arcuate length of 33 inches for the positioning the luminaire. Spacing of the luminaire above the work surface at the ends of the 104 degree arc will provide a height above the work surface of approximately 7½ inches. The luminaire may be adjustably positioned about its pivotal mounting to the board and about its pivotal mounting to the upper ends of support members 24 to afford a variety of selected lighting conditions on the work surface depending upon the desire of the draftsman.

Inclination of drafting board 20 is selected by the draftsman for his convenience. Some draftsman, notably those in Europe, prefer a work surface 21 which is inclined substantially vertically such as shown in FIG. 3, although the inclination may be varied to one somewhat less than 45 degrees to 90 degrees. When the luminaire 23 is moved to different relative positions through the 104 degree arc with respect to the work surface 21 and with the drawing board in substantially vertical position, the gravity force moment of the luminaire 23 is substantially increased. The moment force GM of the support member 24 is at a maximum if the support member 24 is positioned at 90 degrees to the work surface in a drawing board inclined condition as shown in FIG. 3. Such a force moment GM (or length of GM) is substantially zero in the position of the support member 24 relative to the work surface 21 when the luminaire 23 is positioned as shown in FIG. 1. It is therefore, desirable to provide means for counterbalancing the moment arm GM of the luminaire so that the luminaire may be readily moved to a selected position and retained in the selected position without displacement therefrom by gravity or vibratory movements.

Figures 7, 8, 9:
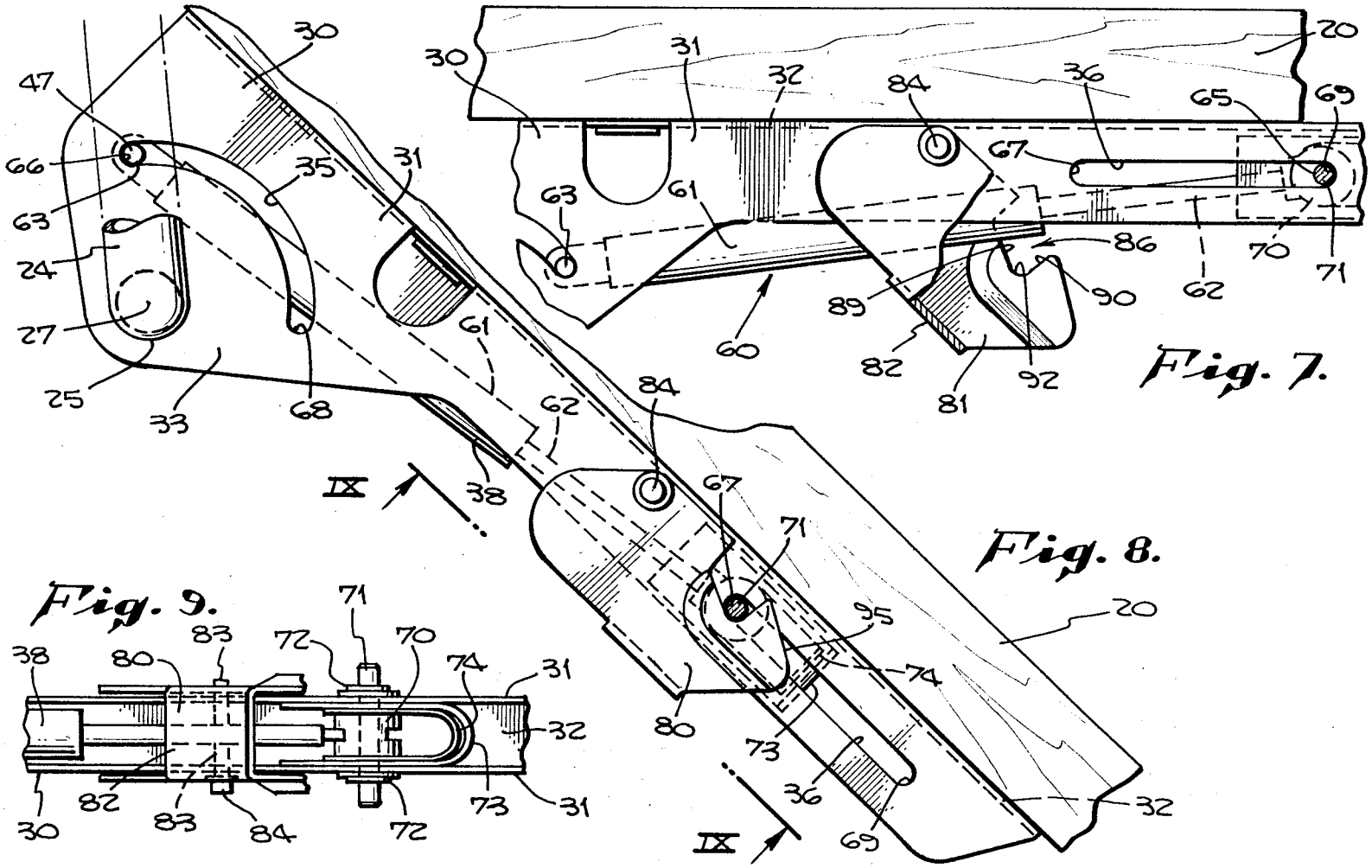
FIG. 7 is an enlarged fragmentary view of the bracket and pendulum latch in one position (horizontal) of the drawing board with the luminaire positioned as in FIG. 1.
FIG. 8 is a fragmentary side view of the bracket means and pendulum latch with the drawing board and luminaire in the position shown in FIG. 2 and at the point of actuation of the gas spring counterbalance means.
FIG. 9 is a fragmentary bottom view of the pendulum latch and bracket taken in the plane indicated by line IX—IX of FIG. 8.

In the present invention, means for controlling the selected position and location of luminaire 23 is provided by a bracket means 30 secured adjacent each side edge of board 20 at a selected location along the length of the side edge to suitably position the luminaire and its support member 24 relative to the work surface. Bracket 30 is best shown in FIGS. 8 and 9. Generally, bracket 30 may be made of suitable metal sheet stock formed into a generally U-shaped cross-section comprising side walls 31 interconnected by a transverse wall 32 forming the bottom of the U section. At one end each side wall 31 is formed with an enlarged generally triangular shaped wall portion 33 to space pivotal mounting 27 a selected distance below board 20. An arcuate slot 35 is provided in each triangular wall portion 33, the radius of the arcuate slot 35 having its center at the axis of pivotal mounting 27.

At the opposite end of bracket 30, a linear slot 36 is provided in each side wall 31 parallel to wall 32. The longitudinal spacing of slots 35 and 36 from each other is correlated with the operable length of a gas spring piston and cylinder 38 for a purpose later described.

A first control means for counterbalancing the luminaire under conditions where the board inclination is between about 0°–45° and the support arm 25 is movable relative to the board through about 104° is now described.

Pivotal mounting 27 of support member 25 is best shown in FIGS. 6, 10. Between side wall end portions 33 is mounted a crank member 40 having spaced crank walls 41 received between wall portions 33 and supporting therebetween a hub 42 provided with an internal split cylindrical serrated surface 43 adapted to engage a complementary serrated external surface on a fixed bushing 44 mounted on end portion 25 of support member 24 and extending through aligned openings in wall portions 33. Engagement of the serrations positions the crank member 40 relative to support member 25, such position being secured by a bolt and nut assembly 44*a* passing through ports 44*b* in crank member 40. Inboardly of bracket means 30, as viewed towards the left in FIG. 6, a drag brake arm 45 may be secured to the inboard face of hub 42. The upper end of brake arm 45 is provided with a polygonal port 46 through which a carriage bolt 47 passes. Bolt 47 extends through a crank glide element 48, through ported ears 49 at the top of crank member 40, through crank glide element 48, through a nylon washer 50, an assembly of conical juxtaposed washers 51, and a second nylon washer 50. A female knob 52 is threaded on the end of bolt 47. When this assembly is tightened by turning knob 52, the shoulders of the carriage bolt 47 will non-rotatably lock in the port 46 of the drag brake arm 45 and the conical washers will provide tension means for said knob and bolt assembly. The brake arm 45 is bent toward the surface of portion 33 to frictionally engage portion 33 to provide counterbalancing forces to hold the luminaire in selected position in different positions of the member 25 relative to the slot 35.

When the luminaire and support member 24 are turned about pivot axis 27, it will be apparent from the above description that the crank member 40 will be turned to cause the bolt 47 and knob 52 assembly above described to move along arcuate slots 35 under selected frictional resistance to permit such movement. The position of the luminaire will be maintained at the selected location under conditions where the inclination of the board is between about 0° to 45°, the movement arm force GM being in the minimal range.

A second control means for counterbalancing the luminaire under conditions of board inclination of about 45°–90° and through the 104° range of the support member 25 relative to the board surface will now be described.

The second control means generally includes a gas spring means 60 having a cylinder 61 and a piston rod 62 in initial extended position as shown in FIGS. 7 (for 0.45° operation) and 8 (for 0.45°–90° operation) under selected fluid pressure to exert a resisting force similar to a spring force at any position of the piston relative to the cylinder to retain the piston in a selected position and the position of the member to which the piston is attached in such position, for example, the strip luminaire assembly.

One end of the cylinder is connected at 63 to the crank 40 by means of the carriage bolt 47 and knob 52 assembly. As previously described, the bolt 47 and knob 52 assembly rides in slot 35. The piston rod 62 is connected to a transverse pin 65 which rides in linear slot 36. The distance between the end 66 of slot 35 and the corresponding end 67 of slot 36 is approximately equal to the distance between the end of cylinder 61 and the end of piston rod 62 when the rod 61 is fully extended from the cylinder. Likewise the chord length between the end 66 and end 68 of slot 35 is approximately equal to the distance between the end 67 and end 69 of slot 36. Under conditions not requiring the counterbalancing force of gas spring 60, the extended piston 62 and cylinder 61 move in slots 35 and 36 without compression or exerting a counterbalancing force.

The end of piston rod 62 is connected to a transversely arranged cylindrical guide element 70 which lies between walls 31 of the bracket. Guide element 70 carries a transverse guide pin 71 which extends through the element 70 and outwardly of slots 36 in the bracket and may be retained by suitable washers and locking clips indicated at 72. Between walls 31 and the end faces of the cylindrical element 70 may be provided an elongated U-shaped bow-type brake 73 within which is nested a bow spring member 74 of similar U-shape which exerts an outwardly directed pressure against the U walls of the brake 73 to press the U walls 73 against the inner surfaces of the walls 31 to exert friction pressure thereagainst. The U walls of the brake 73 and the spring member 74 include aligned ports for passage therethrough of the guide pin 71.

It should be noted that this arrangement of providing friction counterbalancing forces at the end of the piston rod 62 provides a convenient method of assembly of these parts. The U-shaped spring member 74 is readily compressed with the walls urged toward each other by insertion in the U-shaped brake member 73. When the spring and member 73 are assembled and the ports therein aligned, the cylinder member 70 may be inserted between the spring U walls until its hole is aligned with the ports in the spring and member 73. Since the bracket is of U-section, this assembly may be readily inserted between walls 31 and the walls aligned with the slot 36 and the pin 71 then inserted therethrough with the necessary nylon washers and locking clips to retain the pin and the assembly on the bracket. The U-shaped spring being outwardly biased provides a low friction force urging the outer U-shaped brake member 73 against the walls 31 and provides an additional friction counterbalancing force acting throughout movement of the luminaire in any position of the board.

The second control means, that is the gas spring means 60, is activated and becomes operable when the board is tilted to 45° and when the ends of the extended gas spring means 60 reach the ends 66 and 67 of the respective slots 35 and 36. Means for such activation of gas spring means 60 to provide greater counterbalancing forces acting on the support members 25 and the luminaire includes a latch member 80 also of U-section having spaced walls 81 positioned externally of walls 31 of the bracket and the transverse wall 82 interconnecting the latch walls 81. Latch member 80 is freely pivotly connected to bracket 30 by a transverse pin 83. The pin 83 may be retained by a cap nut 84 and in such assembly it is important that the U-shaped latch member 80 which loosely embraces the walls 31 on the bracket be freely and easily pivoted about pin 83. Latch 80 includes on each wall 81 an opening or recess 86. Recess 86 is defined by an edge 87 lying normal to the top edge 88 of the wall 81, a bottom edge 89 lying at a downwardly inclined relation to the top edge 88, and an end edge 90 formed on a radius from the pivot axis of pin 83. The recess 86 thus provides an opening which faces the pin 71 which rides in slot 36 and provides a recess notch 92 formed by a bottom edge 89 and the end edge 90 in an inclined angle of less than 90 degrees to capture and hold pin 71 as later described. The configuration of the recess at its opening in which the outer corner of edge 90 lies below the straight line projection of edge 88 facilitates automatic reception therein of pin 71 as the board is moved to an inclination of 45°.

Latch member 80 is shaped so that the distribution of metal weight therein causes the latch member to pivot about pin 83 relative to the board and bracket as the board is moved from horizontal to about 45°. Such pivotal movement is gravity responsive so that in relation to the floor, ground or horizontal, latch member 80 retains the same orientation because of gravitational forces. It will be understood that weights may be added to the latch to stabilize such maintenance of a gravity position of the latch member, however, for convenience of manufacture and assembly, the shape of the latch member as shown provides the necessary weight distribution to assure necessary gravity response of the latch member as the inclination of the board changes.

In operation of the second control means, involving the gas spring means 60, it will be understood that the first control means described above which utilizes frictional forces at the bolt and knob assembly 47,52 and also the frictional forces at the bow spring 74 and U member 73, will provide counterbalancing forces as the board approaches 45°. As the board and luminaire are positioned at angles beyond 45° and to approximately 90° the gas spring means 60 is operative to provide counterbalancing forces. To provide a smooth transition from the counterbalancing forces of the first control means to the counterbalancing forces of the gas spring means 60, the support members 25 and the luminaire may be positioned with the end of the cylinder located at the end 66 of slot 35, and the pin 71 of the connection of the piston rod 62 to slot 36 is located against end 67 of slot 36. As the board is inclined from, for example, a horizontal position to 45°, the length member 80 retains its gravity oriented position, and as the board approaches 45°, the pin 71 is received within the opening of recess 86 and is captured at the bottom corner of the recess at 92. Pin 71 is thus held against movement relative to slot 36 and the bracket. When the board has reached the selected inclined position between 45° and 90°, the luminaire and support members may be suitably adjusted to provide the desired illumination of the selected work area. In positioning the luminaire, the support members 25 cause the connection at 47 or 66 to ride in slot 35 towards the now fixed position at 67 of pin 71 at the end of the piston rod 62. Thus as the luminaire is moved to different positions as schematically illustrated in FIG. 3, the gas spring means 60 is operative to provide the necessary additional counterbalancing forces so that the luminaire may be moved to a selected position and retained at such position by the combination of the counterbalancing forces.

Under some conditions of ajdustments of the inclination of the board and luminaire, the pins 47 and 71 may be at an intermediate location in their respective slots 35 and 36. In the range of inclination between 45° to 90° and with the pins located at positions other than the ends 66 and 67 of the respective slots 35 and 36 as above described, the gravity responsive latch 80 may permit capturing of the pin 71 when the support members 25 and luminaire are moved upwardly toward the end of the slots by means of the cam edge 95 provided on the front edge portions of the walls 81. It is necessary, however, that to activate the second control means, that is the gas spring 60, that the pin 71 be locked in the recess 86 of the latch member 80.

When the latch member is in the position shown in FIG. 8, and the second control means is operative, it will be understood that when the board is inclined to a position below 45° and the luminaire adjusted for such lower inclination, that the latch member 80 because of its gravity response automatically unlocks the pin 71 so that the friction means of the first control means is operable and adjustment of the luminaire may be readily made at such lower inclined position for the board.

The dual counterbalancing system described above is automatically operable and the transition from the first counterbalance control means to the second counterbalance control means is smoothly performed. The gravity responsive pendulum latch is substantially fool proof and requires little maintenance. The gas spring means selected should include a spring force load rating to provide the necessary counterbalancing force for the size and weight of the luminaire. A gas spring means is a preferable means for the above described purpose, however, other spring force means having similar characteristics such as a coil spring member may be utilized.

Various changes and modifications may be made in the control mounting for a luminaire as described hereinabove and which may fall within the spirit of this invention and all such changes and modifications coming within the scope of the appended claims are embraced therefor.

I claim:

1. In an apparatus for illuminating a work surface on a drafting board or the like which is adapted to be inclined between horizontal and approximately vertical positions, the combination of:

bracket members carried on opposite sides of a drafting board;

a luminaire support member extending above and across said work surface and pivotally mounted from said bracket members;

and means on each of said bracket members for controlling pivotal movement of the luminaire support member relative to the work surface at inclined positions of the drafting board between the horizontal and vertical positions;

said controlling means including a crank means at the pivotal mounting of said luminaire support member and connected therewith, and first and second control means cooperable with said crank means and moveable along paths provided by said bracket means for counterbalancing and maintaining a selected position of the luminaire support member.

2. An apparatus as stated in claim 1 including slot means in said bracket members providing said paths, said first control means including spaced friction means moveable along said slot means and interconnected with said crank member.

3. An apparatus as stated in claim 2 wherein said second control means includes a gas spring means extending between said friction means in said slot means, said gas spring means being activated in one position of said friction means in said slot means.

4. An apparatus as stated in claim 2 wherein said slot means includes an arcuate slot adjacent said crank means and having one of the friction means associated therewith, and a linear slot spaced therefrom and having the other friction means associated therewith, said friction means in said slot means being interconnected by said gas spring means.

5. An apparatus as stated in claim 1 wherein said first means is primarily operable for positioning said luminaire support member from a work surface horizontal position to approximately a work surface 45 degrees position.

6. An apparatus as stated in claim 5 wherein said second means is activated after said first means has reached one end of the said slot means, and wherein said second means is operable for positioning said luminaire support member in angular positions of the work surface between 45 degrees and approximately 90 degrees.

7. An apparatus as stated in claim 1 including means for activating said second means including a latch member cooperable with said second means for retaining said second means in a selected position.

8. In an apparatus for counterbalancing a luminaire pivotally mounted on a board member adapted to be inclined to a selected working position and moveable relative to said board, the combination of:

support means for said luminaire;

means for pivotally mounting the support means on said board;

first and second control means cooperable with said pivotal mounting means for providing counterbalancing forces in selected positions of the luminaire;

and means for activating said second control means for augmenting the counterbalancing forces of said first control means when said board is inclined beyond a selected angle of inclination.

9. In an apparatus as defined in claim 8 wherein said activating means includes a gravity responsive means engageable with said second control means.

10. An apparatus as defined in claim 8 wherein said second control means includes a fluid pressure spring means connected at one end with said first control means;

and means connected with the other end of said spring means for restricting movement thereof relative to said first control means.

11. An apparatus as defined in claim 10 wherein said restriction means is operable at a selected angle of inclination of said board.

12. An apparatus as stated in claim 8 wherein said means for activating said second control means includes a bracket member carried by said board;

said means for activating said second control means including a latch member pivotally mounted on said bracket member and operable at a selected inclined position of said board.

13. In an apparatus for illuminating a work surface which is adapted to be inclined to a selected working position, the combination of:

means for pivotally mounting a luminaire above said work surface;

control means cooperable with said pivotal mounting means to provide counterbalancing forces of different magnitude at different inclinations of the work surface;

said control means including bracket means extending along sides of said work surface;

said bracket means having spaced path means;

a counterbalancing means interconnecting said path means and operable at selected inclinations of said work surface;

and means on said bracket means for actuating said counterbalancing means at one of said path means at a selected angle of inclination.

14. An apparatus as claimed in claim 13 wherein said means for actuating said counterbalancing means includes:

a latch member cooperaable with said counterbalance means adjacent an end of said one path means.

15. An apparatus as claimed in claim 14 wherein said latch means is pivoted on said bracket means and responsive to gravity to engage said counterbalance means.

* * * * *